US005216465A

United States Patent [19]

Arai et al.

[11] Patent Number: 5,216,465

[45] Date of Patent: Jun. 1, 1993

[54] PRINT CARTRIDGE INSERTABLE INTO AN IMAGE FORMING APPARATUS

[75] Inventors: Akio Arai; Takashi Kanagawa; Kiyoshi Chatani, all of Kanagawa, Japan

[73] Assignee: Fuji Xerox Co., Ltd., Tokyo, Japan

[21] Appl. No.: 884,052

[22] Filed: May 15, 1992

Related U.S. Application Data

[63] Continuation of Ser. No. 666,911, Mar. 11, 1991, abandoned.

[30] Foreign Application Priority Data

Mar. 19, 1990 [JP] Japan ..... 2-69201

[51] Int. Cl.[5] ..... G03G 15/02; G03G 21/00

[52] U.S. Cl. ..... 355/210; 250/324; 355/221; 355/225

[58] Field of Search ..... 355/200, 210, 219, 221, 355/222, 225; 250/324, 325, 326

[56] References Cited

U.S. PATENT DOCUMENTS

| | | | |
|---|---|---|---|
| 4,652,754 | 3/1987 | Almeter et al. | 355/225 X |
| 4,792,680 | 12/1988 | Lang et al. | 250/325 |
| 4,806,967 | 2/1989 | Newbury | 355/210 |
| 4,835,568 | 5/1989 | Howard et al. | 355/219 |
| 5,079,668 | 1/1992 | Maeshima | 355/225 X |

FOREIGN PATENT DOCUMENTS 62-65049 3/1987 Japan .

*Primary Examiner*—Fred L. Braun

*Attorney, Agent, or Firm*—Finnegan, Henderson, Farabow, Garrett & Dunner

[57] ABSTRACT

A print cartridge for an image forming apparatus which is insertable into a body of the image forming apparatus, the print cartridge includes an image carrying body, a housing rotatably supporting the image carrying body, and a primary static charger for electrostatically charging the image carrying body, the primary static charger being removably mounted on the housing. The primary static charger has a grid disposed between the corotron wire and the image carrying body which is contacted by a leaf spring to bias the primary static charger toward the housing and also fix the grid on the housing.

3 Claims, 5 Drawing Sheets

PRINT CARTRIDGE INSERTABLE INTO AN IMAGE FORMING APPARATUS

This application is a continuation of application Ser. No. 07/666,911, filed Mar. 11, 1991 now abandoned.

BACKGROUND OF THE INVENTION

This invention relates to a print cartridge for an image forming apparatus, such as an electrophotographic copying machine and a printer, by which a cartridge, an image carrying body, a primary static charger and a cleaner can be integrally withdrawn from and inserted into a body of the apparatus.

In a known image forming apparatus, image forming devices, such as a primary static charger, an image exposing portion, a developing device, a transfer static charger and a cleaner, are arranged around the periphery of an image carrying body. After the surface of the image carrying body is uniformly and electrostatically charged by the primary static charger, the image is exposed to form an electrostatic latent image, and this electrostatic latent image is developed by the developing device into a visible image. This visible image is transferred to paper by the transfer static charger. The paper is fed to a fixing device for fixing purposes, and the residual toner on the image carrying body is cleaned off by the cleaner.

In such an image forming apparatus, the lifetime of the image carrying body as well as the lifetime of the image forming devices are short, and they need to be periodically inspected, repaired and exchanged. For example, as disclosed in Japanese Laid-Open (Kokai) Patent Application No. 65049/87, an image carrying body and some of image forming devices are integrally formed into a print cartridge, and the print cartridge is removably attached to the body of the apparatus, thereby facilitating a maintenance such as inspection, repair and exchange operations.

In the above-mentioned print cartridge of the type in which the image carrying body and the primary static charger are integrally formed into the print cartridge, in the case where high voltage is applied to the primary static charger, or in the case of corotron where the primary static charger has a grid, in order to reduce the electric field strength E (KV/cm) to prevent leakage, it has been recently common practice to electrically connect the grid and a shield electrode of the primary static charger to keep them at the same electric potential. It is also common practice to apply a bias thereafter so that the grid and the shield (serving as the shield electrode of the primary static charger) can be at the same electric potential. Therefore, it is necessary to apply the bias to the shield and the grid from the apparatus body, and besides, the primary static charger and the grid need to be removably attached to the apparatus body. Therefore, these are very cumbersome and difficult.

SUMMARY OF THE INVENTION

It is therefore an object of this invention to provide a print cartridge for an image forming apparatus which overcomes the above problems.

According to the present invention, a print cartridge for an image forming apparatus which is insertable into a body of the image forming apparatus, comprises an image carrying body, a housing rotatably supporting said image carrying body, and a primary static charger for electrostatically charging said image carrying body, said primary static charger being removably mounted on said housing.

With this construction, since the image carrying body and the primary static charger can be integrally withdrawn from and inserted into the apparatus body, the inspection, repair and exchange of them can be done easily.

DESCRIPTION OF THE PREFERRED EMBODIMENT

Figure 5:
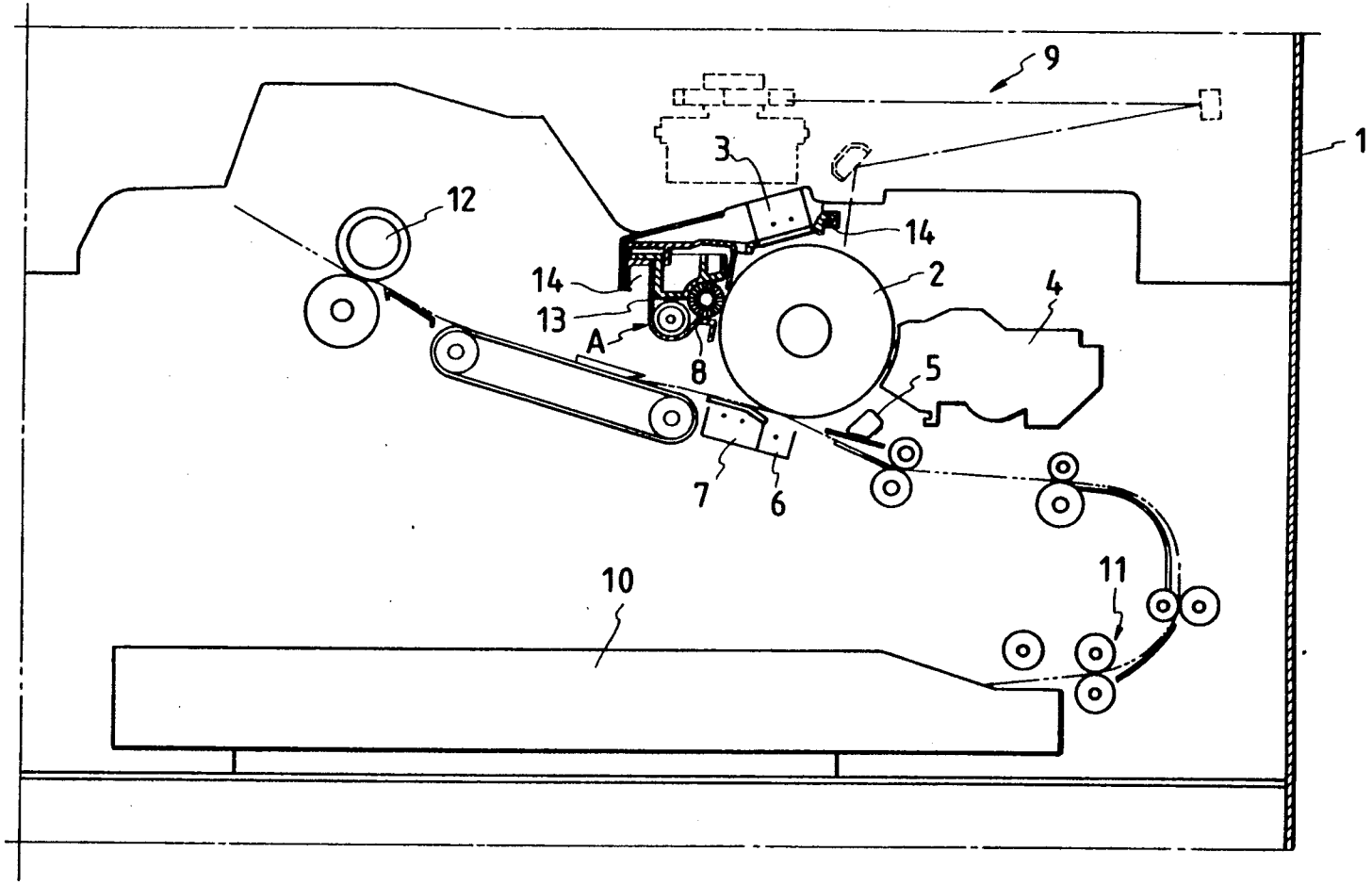
FIG. 5 is a schematic view of an image forming apparatus.
Figure 6:
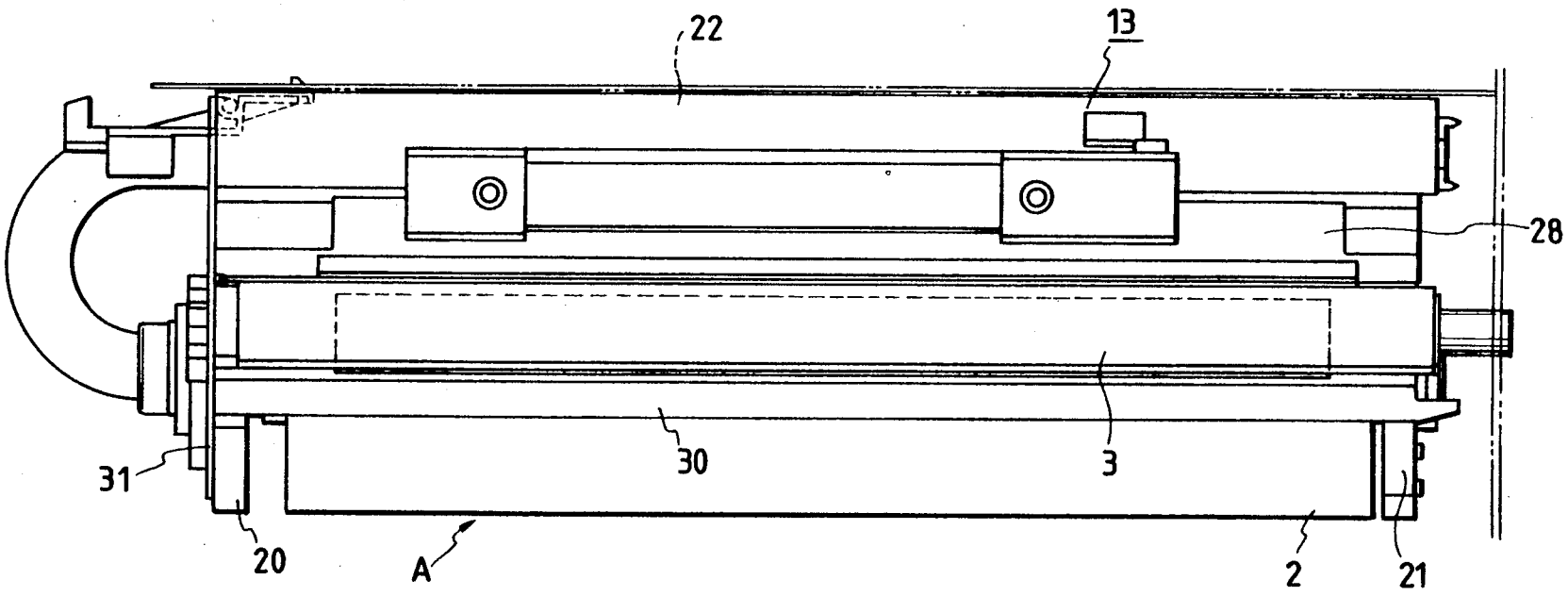
FIG. 6 is a plan view of a print cartridge.
Figure 7:
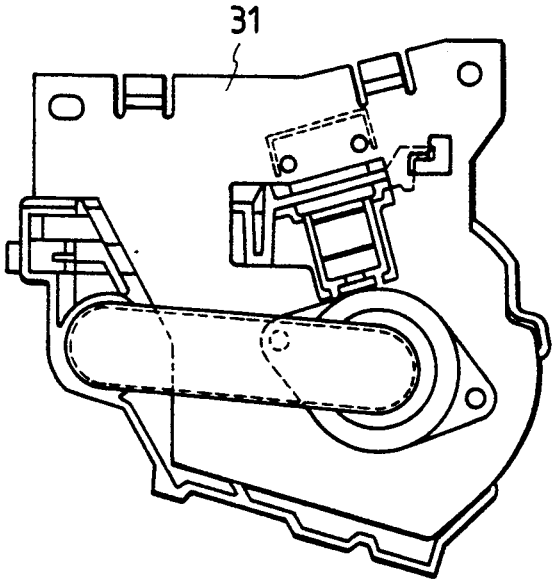
FIG. 7 is a left side view of the print cartridge.
Figure 8:
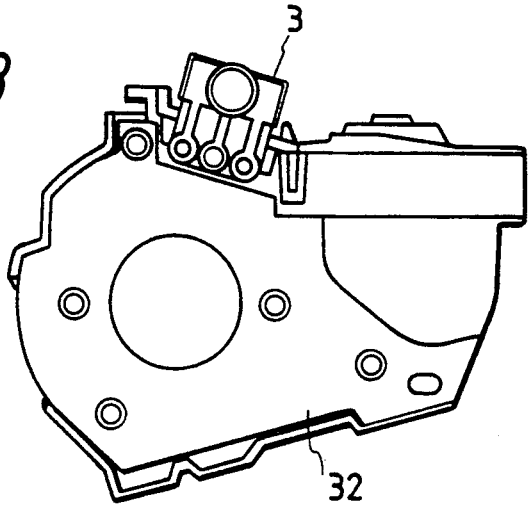
FIG. 8 is a right side view of the print cartridge.
Figure 9:
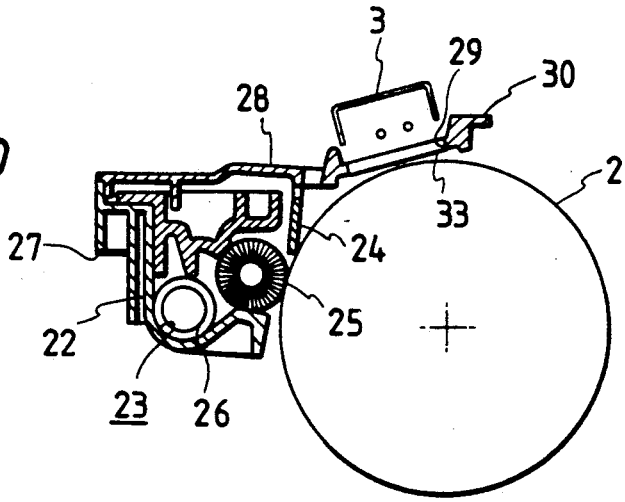
FIG. 9 is a vertical cross-sectional view through the central portion of the print cartridge.

FIG. 5 is a schematic view explanatory of an image forming apparatus. An image carrying body 2 is provided on an apparatus body 1, and a primary static charger 3, a developing device 4, a pre-transfer static charger 5, a transfer static charger 6, a separating static charger 7, a cleaner 8 and the like, are sequentially arranged around the image carrying body 2. After the surface of the image carrying body 2 is electrostatically charged uniformly by the primary static charger 3, an image exposure is carried out by an image exposing mechanism 9 to thereby form an electrostatic latent image. The electrostatic latent image is developed by the developing device 4 into a visible image. Paper in a paper tray 10 is fed by a paper feed mechanism 11 toward the image carrying body 2, and the above visible image is transferred by the transfer static charger 6 to the paper, and the paper is fed to a fixing device 12 where the paper is fixed to provide a copy.

The image exposing mechanism 9 is of the laser type comprising a laser beam generator, a rotary mirror, and a plurality of mirrors. This image exposing mechanism receives image information from an external office automation device, such as a computer and a word processor, so as to expose an image on the image carrying body.

The image carrying body 2, the primary static charger 3 and the cleaner 8 are mounted on a housing 13 to constitute a print cartridge A. The housing 13 is insertable and withdrawable along guide rails 14 mounted on the apparatus body 1 so that the print cartridge A is withdrawable from and insertable into the apparatus body 1.

As shown in FIGS. 6 to 9, the housing 13 has a first side plate 20, a second side plate 21 and a peripheral wall 22. The peripheral wall 22 has a cleaner housing 23 in which a cleaning blade 24, a disturber brush 25, which has an annular brush, and an auger 26 are provided. The peripheral wall 22 has a first side slide rail 27. A cover member 28 is mounted between the first side plate 20 and the second side plate 21 over the upper surfaces thereof. An open window 29 is longitudinally formed through the cover member 28, and a projected end portion of the cover member 28 serves as a second side slide rail 30. A positioning side plate 31 is mounted on the first side plate 20, and a side plate 32 is mounted on the second side plate 21. The primary static charger 3 is mounted on the cover member 28, and a grid 33 of the primary static charger 3 is mounted between the cover member 28 and the upper surfaces of the first and second side plates 20 and 21.

With this construction, the first side slide rail 27 and the second side slide rail 30 of the housing 13 are slidable respectively along the guide rails 14, provided on the apparatus body 1, in the axial direction of the image carrying body 2.

Next, the mounting of the primary static charger 3 and the grid 33 will now be described.

Figure 1:
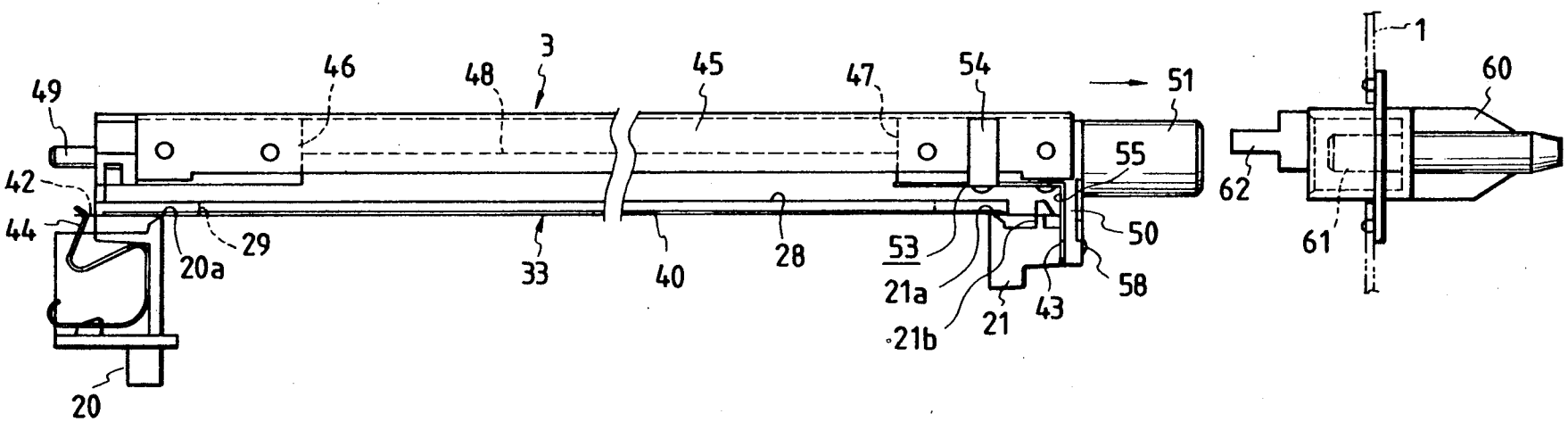
FIG. 1 is a vertical cross-sectional view showing the condition of mounting of a cartridge.
Figure 4:
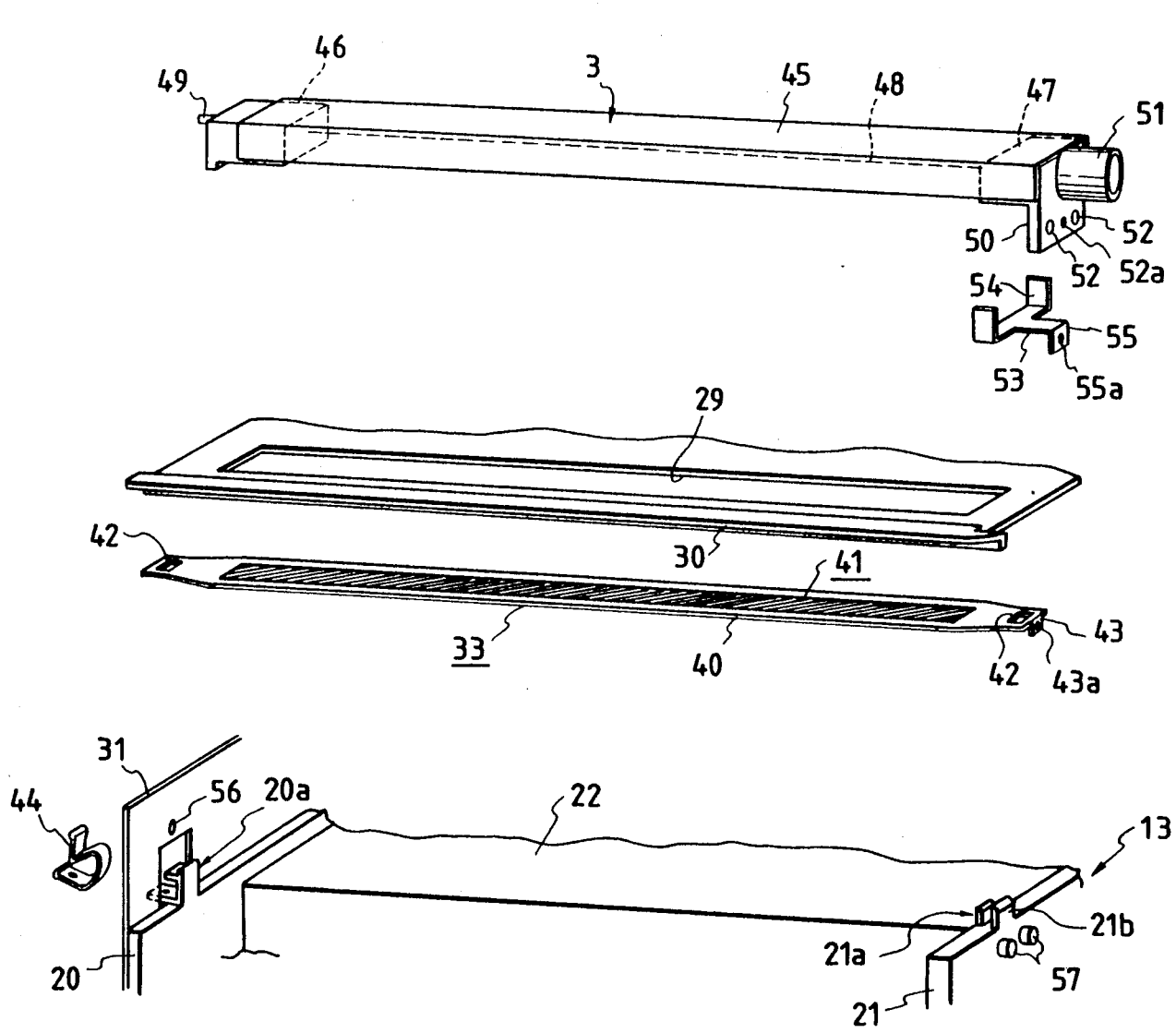
FIG. 4 is an exploded perspective view of the cartridge.

As shown in FIG. 4, the grid 33 comprises a thin plate 40 having a number of slits 41 at its longitudinally intermediate portion, and openings 42 and 42 are formed respectively through the opposite longitudinal ends of the thin plate 40. One end of the thin plate 40 is bent to serve as a mounting piece 43. As shown in FIG. 1, the opposite longitudinal ends of the thin plate 40 are pressed respectively against pointed ends 20*a* and 21*a* of the first side plate 20 and the second side plate 21 by the cover member 28. A leaf spring 44 provided on the first side plate 20 is engaged with the first side of the openings 42, and the mounting piece 43 is connected by a screw to the outer surface of the second side plate 21, as later described. The other opening 42 is urged against a projection piece 21*b* of the second side plate 21 by the leaf spring 44, thereby positioning the grid 33 relative to the housing 13.

As shown in FIG. 1, the primary static charger 3 comprises a metallic shield 45, and first side block 46 and a second side block 47 are mounted respectively on the opposite longitudinal ends of the shield 45. A corotron wire 48 is extended between the first side block 46 and the second side block 47. A positioning pin 49 is mounted on the first side block 46, and a mounting piece 50 and a connector 51 are mounted on the second side block 47. A pair of positioning holes 52 and 52 are formed through the mounting piece 50, and a spring shield 53 is mounted on the other longitudinal end portion of the shield 45. The spring shield 53 comprises a U-shaped fitting piece 54, and a hook-shaped mounting piece 55. The fitting piece 54 snappingly fits on the shield 45.

Figure 2:
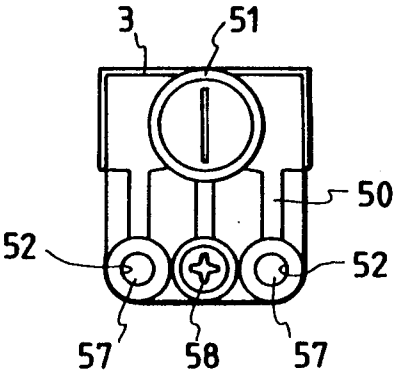
FIG. 2 is a side view of the cartridge.

A positioning hole 56 is formed through the positioning side plate 31 of the housing 13, and a pair of positioning pins 57 and 57 are formed on the second side plate 21. As shown in FIG. 1, by moving the primary static charger 3 along the cover member 28, the positioning pin 49 provided on the first side block 46 is fitted in the positioning hole 56 of the positioning side plate 31, and the pair of positioning pins 57 formed on the second side plate 21 are fitted respectively in the pair of the positioning holes 52 formed through the support pieces 50 of the second side block 47, thereby positioning the primary static charger 3 relative to the housing 13. As shown in FIGS. 1, 2 and 4, a screw 58 is passed through a hole 52*a* of the mounting piece 50, a hole 55*a* of the mounting piece 55 of the spring shield 53 and a hole 43*a* of the mounting piece 43 of the grid 33, and is threaded into the second side plate 21 of the housing 13, thereby securing the primary static charger 3 to the housing 13.

With this arrangement, the mounting piece 43 of the grid 33 and the mounting piece 53 of the spring shield 55 are held in pressure contact with each other, and the fitting piece 54 of the spring shield 53 is held in pressure contact with the shield 45. Therefore, the shield 45 of the primary static charger 3 is electrically connected to the grid 33.

Figure 3:
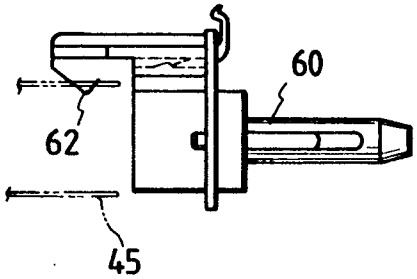
FIG. 3 is a plane view of a body-side connector.

As shown in FIG. 1, an apparatus body-side connector 60 is provided in opposed relation to the connector 51, and the apparatus body-side connector 60 has a corotron wire-energizing terminal 61 and a bias-applying terminal 62 made of a spring. When the housing 13 is moved in the direction of the arrow, the connector 51 of the primary static charger 3 is fittingly engaged with the terminal 61 of the apparatus body-side connector 60 shown in FIG. 3. As a result, high voltage is applied to the corotron wire 48 from the apparatus body 1, and the shield 45 is in contact with the bias-applying terminal 62, so that the shield 45 and the grid 33 are maintained at the same electric potential.

According to the present invention, since the image forming member 2, the primary static charger 3 and the grid 33 can be withdrawn from and inserted into the apparatus body 1 in unison, the inspection, repair and exchange of them can be done easily.

When the print cartridge is inserted into the apparatus body 1, the connector 51 of the primary static charger 3 is connected to the terminal 61 of the apparatus body-side connector 60 to apply high voltage to the corotron wire 48, and the shield 45 of the primary static charger 3 is brought into contact with the bias-applying terminal 62. The shield 45 is electrically connected to the grid 33 via the spring shield 53, and therefore the shield 45 and the grid 33 can be maintained at the same electric potential.

Further, the grid 33 can be positioned relative to the housing 13 by the mounting piece 43 and the leaf spring 44, and the primary static charger 3 can be positioned by the positioning pins 49 and 57 and the positioning holes 56 and 52, and the mounting piece 43 of the grid 33, the spring shield 53 and the mounting piece 50 of the primary static charger 3 can be connected by the common screw 58. Therefore, the mounting of these parts on the housing 13 can be done easily.

What is claimed is:

1. A print cartridge for an image forming apparatus that is insertable into a body of the image forming apparatus, said print cartridge comprising:

an image carrying body;

a housing rotatably supporting said image carrying body; and a primary static charger for electrostatically charging said image carrying body, said primary static charger being removably mounted on said housing, wherein said primary static charger includes a corotron wire, a shield covering said corotron wire, a grid disposed between said corotron wire and said image carrying body, and connection means for electrically connecting said grid to said shield, said connection means including a fitting piece for fitting said connection means to said shield and a mounting piece for attaching said connection means to said grid by a fastening means, whereby said grid and said shield are easily separable.

2. A print cartridge for an image forming apparatus according to claim 1, further comprising a leaf spring for urging said primary static charger against said housing, said leaf spring having a shape to allow said grid to be fixed onto said housing.

3. A print cartridge for an image forming apparatus that is insertable into a body of the image forming apparatus, said print cartridge comprising:

an image carrying body;

a housing rotatably supporting said image carrying body;

a primary static charger for electrostatically charging said image carrying body, said primary static charger being removably mounted on said housing, wherein said primary static charger includes a corotron wire, a shield covering said corotron wire, a grid disposed between said corotron wire and said image carrying body, and connection means for electrically connecting said grid to said shield, said connection means including a fitting piece for fitting said connection means to said shield, whereby said grid and said shield are easily separatable; and a leaf spring contacting said grid for biasing said primary static charger toward said housing, said leaf spring having a shape to allow said grid to be fixed onto said housing.

* * * * *